United States Patent [19]

Black et al.

[11] 3,974,579

[45] Aug. 17, 1976

[54] BUCKET TOOTH ADAPTER SUPPORT AND LOAD TRANSFER MEANS

[75] Inventors: William J. Black, Wilmington; William E. Lanz, Joliet, both of Ill.

[73] Assignee: Caterpillar Tractor Co., Peoria, Ill.

[22] Filed: Feb. 4, 1975

[21] Appl. No.: 546,951

[52] U.S. Cl. ..... 37/141 T; 37/142 R

[51] Int. Cl.[2] ..... E02F 9/28

[58] Field of Search ..... 37/141 R, 141 T, 142 R, 37/142 A

[56] References Cited

UNITED STATES PATENTS

| | | | |
|---|---|---|---|
| 1,772,624 | 8/1930 | Brendlin | 37/141 R |
| 1,856,930 | 5/1932 | Robin | 37/142 R |
| 2,145,663 | 1/1939 | Reynolds | 37/141 T |
| 2,385,395 | 9/1945 | Baer | 37/142 R |
| 3,197,895 | 8/1965 | Cooke | 37/142 R |
| 3,413,739 | 12/1968 | Guinot | 37/142 R |
| 3,463,523 | 8/1969 | Vasas | 287/189.36 |
| 3,841,007 | 10/1974 | Howarth et al. | 37/141 R |

*Primary Examiner*—Edgar S. Burr
*Assistant Examiner*—R. E. Suter
*Attorney, Agent, or Firm*—Phillips, Moore, Weissenberger Lempio & Strabala

[57] ABSTRACT

The tool of an earthworking machine has a support and load transfer lug attached to the internal surface of the tool at the cutting edge by an attaching portion and a cylindrical mating portion extending forwardly and overlapping the cutting edge. A tooth adapter is mounted on the lug by means of a cavity in one side of the adapter, the cavity overlapping the attached portion of the lug, and a cylindrical bore communicating with the cavity closely fitting on the mating portion of the lug. The tooth adapter extends forwardly and carries thereon a tooth. A bolt extends through a rearward extension of the tooth adapter and the cutting edge of the tool to detachably affix the tooth adapter to the tool.

5 Claims, 4 Drawing Figures

BUCKET TOOTH ADAPTER SUPPORT AND LOAD TRANSFER MEANS

BACKGROUND OF THE INVENTION

The maintenance of durable, trouble-free and readily serviceable bulldozer and bucket tooth and adapter mountings continues to pose problems. The concentrated peak loads applied to projecting teeth create high shearing stresses that tend to fail bolts and pins used to couple or retain associated members. This tendency to shear bolts and pins is aggravated by abrasion to the retaining members caused by loading and off loading earth or gravel to such buckets.

Hardened annular shear lugs fitting tightly in opposed recesses and about the retaining bolts and various types of interlocking keys are currently utilized to minimize the detrimental effect of such shear loads. Such a retention means is set forth in U.S. patent application Ser. No. 423,161 (now abandoned), assigned to the assignee of this application. High stress loads are occasionally compensated for by use of larger reinforced adapters and mountings which is both wasteful and costly. U.S. Pat. No. 1,856,930 shows an adapter to which a tooth is affixed by a bolt and a nut, the bolt having concentrically fitted plugs surrounding it to absorb the shear loads on the tooth. The adapter in this patent is apparently bolted to the cutting edge of the tool. U.S. Pat. No. 2,385,395 shows a tooth secured to an adapter by a rearwardly projecting tapered shank nesting within a socket of the adapter, the tooth being held in place by a clamp or wedge member and a bolt. U.S. Pat. No. 3,197,895 teaches a means for attaching a cutting edge member to a blade utilizing bolts which have auxiliary holding surfaces, such that when the head of the bolt wears away, the auxiliary holding surface will retain the cutting edge. U.S. Pat. No. 3,413,739 affixes a tooth to a cutting edge by means of a locking bar and bolt, the bar acting as a cam or wedge to tightly retain the tooth. U.S. Pat. No. 3,463,523 teaches a method for attaching a cutting edge to a scraper blade by means of large diameter studs projecting from a mounting plate fixed to the rear of the blade and projecting through the scraper blade and the cutting edge. U.S. Pat. No. 3,841,007, assigned to the assignee of this application, discloses a tip adapter mounted in a groove of the support member and retained therein by a bolt and pin. Shear loads being absorbed by the support member in combination with the bolt.

It is noted that in five of the six previously issued patents, stress loads imposed on the tooth are primarily absorbed by either a bolt or a bolt in combination with some other device. In the sixth, U.S. Pat. No. 3,463,523, forces are absorbed by a bolt and pin arrangement.

SUMMARY OF THE INVENTION

It is accordingly an object of this invention to provide a support and load transfer lug welded to the internal surface of the cutting edge of a tool in an earth working machine such that a tip adapter may be mated with the support and load transfer lug by a cylindrical portion of the lug fitting in a similar cylindrical cavity of the adapter.

It is a further object of this invention to provide a support and load transfer lug, which while fulfilling the above object will absorb and transfer load forces imposed on the bucket tooth to the cutting edge of the tool.

It is a further object of this invention to provide a support and load transfer lug fulfilling the above objects and in combination with a tooth adapter to provide a readily serviceable and simply manufactured tooth support and load transfer means.

Broadly stated, the invention is a load transfer lug for a tooth adapter to be used on the tool of an earthworking machine, the lug having a mating portion for closely mating the lug internally with a tooth adapter, and an attachment portion for affixing the lug to the tool, whereby forces imposed on the tooth adapter are transferred by the lug to the tool.

BRIEF DESCRIPTION OF THE DRAWINGS

These and other objects of the invention will become apparent from a study of the following specification and drawings, in which.

DESCRIPTION OF THE DRAWINGS

Figure 1:
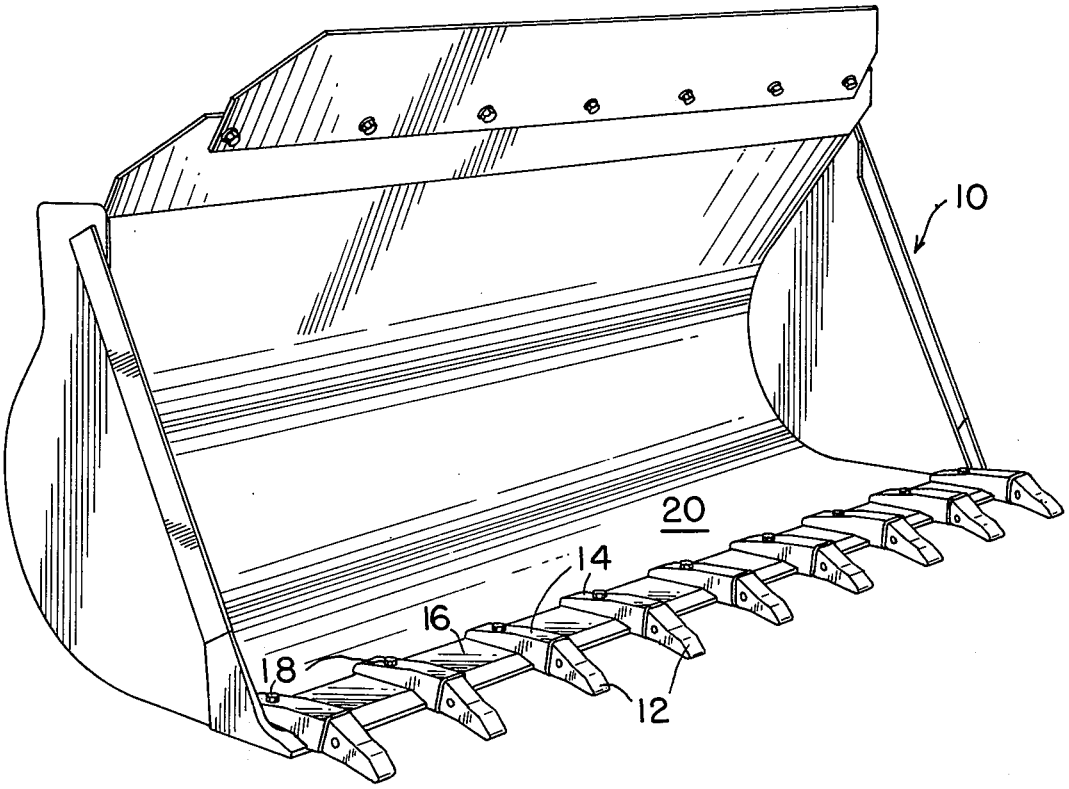
FIG. 1 illustrates an earthworking tool to which a plurality of teeth adapters to which teeth have been affixed, the teeth adapters shown mounted on support and load transfer lugs.

Referring to FIG. 1, a tool 10, here shown as a bucket of an earthworking machine, is fitted with a plurality of teeth 12 through the use of complementing teeth adapters 14, rigidly secured to cutting edge 16 by bolts 18, the teeth adapters being mounted on support and load transfer lugs which will become apparent. Cutting edge 16 may be a separate member affixed to tool bottom 20 or may itself constitute a portion of tool bottom 20.

Figure 2:
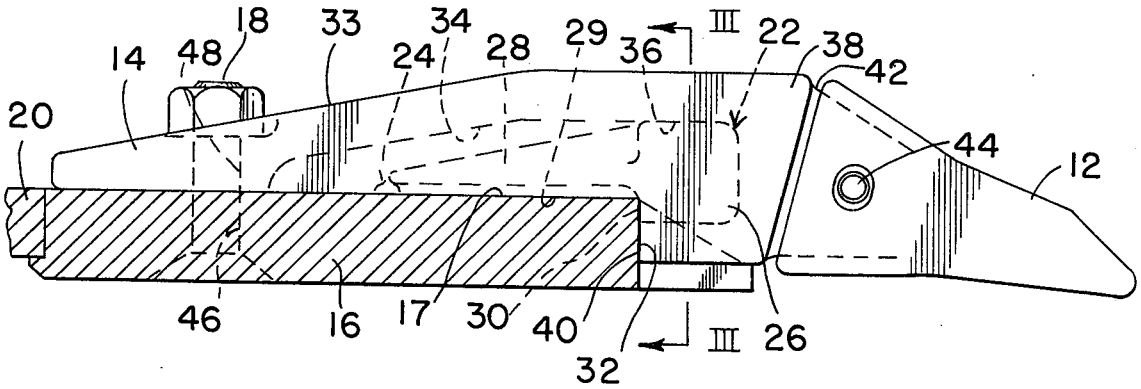
FIG. 2 illustrates the support and load transfer lug mated internally with a tooth adapter, the tooth adapter having a tooth affixed thereto.

Referring to FIG. 2, a support and load transfer lug 22 is affixed to the interior surface 17 of cutting edge 16. Support and load transfer lug 22 is illustrated as being welded to surface 17 at 24. It is to be understood that other means of affixing support and load transfer lug 22 may be utilized. Support and load transfer lug 22 has extending forwardly from cutting edge 16 a cylindrical mating portion 26, and extending rearwardly a tapered attachment portion 28 having an essentially flat surface 29 abutting with cutting edge 16. Formed by the cylindrical mating portion 26 and at the juncture of mating portion 26 and attachment portion 28 is a shoulder 30 which abuts leading edge 32 of cutting edge 16. Shoulder 30 is essentially at a right angle to flat surface 29.

Tooth adapter 14, an elongated member having a rearward extension 33, defines a cavity 34 within rearward extension 33 of greater dimension than attachment portion 28 of support and load transfer lug 22. Tooth adapter 14 has an enlarged portion 38 defining a cylindrical bore 36 oriented longitudinally of tooth adapter 14 communicating with cavity 34. Cylindrical bore 36 is of sufficient dimension to closely mate internally with cylindrical mating portion 26 of support and load transfer lug 22. Enlarged portion 38 defines a shoulder 40 at the juncture of enlarged portion 38 and rearward extension 33 which abuts leading edge 32 with adapter 14 mated internally with support and load transfer lug 28. Cavity 34 of tooth adapter 14 is sufficiently elongated so that tooth adapter 14 may be mated with cylindrical mating portion 26 of support and load transfer lug 22 and slipped rearwardly engaging interior surface 17 of tool 10 to enable attaching bolt 18 to be inserted through bore 48 and matching aperture 46 in cutting edge 16. Tooth adapter 14 has a forwardly extending projection 42 on which tooth 12 may be received. Tooth 12 is retained on forwardly extending projection 42 by attaching means 44 here illustrated as a press fitted pin.

Figure 3:
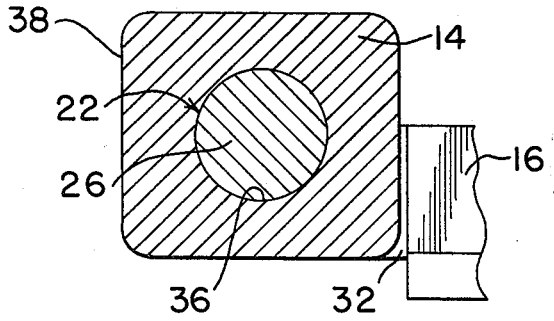
FIG. 3 is a cross-sectional view of the support and load transfer lug and tooth adapter taken at line III—III as shown in FIG. 2.

Referring to FIG. 3, the close fit of cylindrical bore 36 to cylindrical mating portion 26 of support and load transfer lug 22 is illustrated. Also illustrated is the rectangular construction of enlarged portion 38 of tooth adapter 14. Such rectangular construction insures maximum contact of shoulder 40 with leading edge 32.

Figure 4:
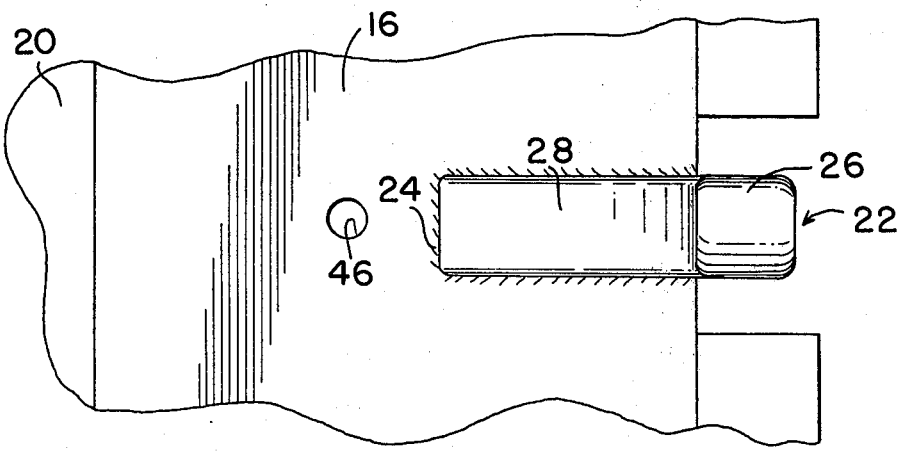
FIG. 4 illustrates the support and load transfer lug affixed to the cutting edge of the earthworking tool.

Referring to FIG. 4, the relationship of cylindrical mating portion 22 is shown to cutting edge 16. Also shown is aperture 46 in cutting edge 16 which would receive bolt 18 upon mounting a tooth adapter 14 on support and load transfer lug 22. As can be readily seen, shear loads imposed on a tooth 12 which would normally impinge on bolt 18 are now to a maximum extent absorbed by support and load transfer lug 22.

What is claimed is:

1. A support and load transfer lug for a tooth adapter for mounting at the cutting edge of the tool of an earthworking machine, said tooth adapter having a longitudinally extending cylindrical bore, said tool defining an interior surface; the support and load transfer lug having a mating portion for closely mating said lug with said tooth adapter, and an attachment portion for affixing said lug to said tool, said attachment portion unitarily formed with said mating portion, said attachment portion comprising a tapered rearward extension having a substantially flat surface for abutting the interior surface of said tool, said mating portion comprising a forwardly extending cylindrical portion formed to be slidably received in the longitudinally extending cylindrical bore of said tooth adapter, said cylindrical portion defining a shoulder at the juncture of said cylindrical portion and the attachment portion, the shoulder being at substantially a right angle to the flat surface of said attachment portion; said shoulder for abutting the cutting edge of said tool; whereby load forces imposed on said tooth adapter are transferred by said lug to said tool.

2. The combination set forth in claim 1 wherein the tooth adapter comprises an elongated member having an enlarged portion, a forwardly extending projection unitarily formed therewith for receiving a tooth and a rearward extension unitarily formed with said enlarged portion to define a tooth adapter juncture therebetween, said rearward extension defining a cavity in one side, said enlarged portion defining the longitudinally extending cylindrical bore, said cylindrical bore communicating with said cavity, said cavity in said rearward extension for overlapping the attachment portion of the support and load transfer lug with said cylindrical portion of said support and load transfer lug received in said cylindrical bore.

3. The combination set forth in claim 2 wherein the rearward extension of said tooth adapter engages the interior surface of said tool.

4. The combination set forth in claim 3 wherein the tooth adapter further defines a tooth adapter shoulder at the tooth adapter juncture, said tooth adapter shoulder for abutting the cutting edge of the tool with the cylindrical portion of the support and load transfer lug received in the longitudinally extending cylindrical bore of the enlarged portion.

5. The combination set forth in claim 4 wherein said rearward extension of said tooth adapter further defines an aperture near its rearmost extremity, for receiving an attaching bolt means for rigidly affixing said tooth adapter to said tool.

* * * * *